US006503179B2

(12) United States Patent
Miraflor

(10) Patent No.: US 6,503,179 B2
(45) Date of Patent: Jan. 7, 2003

(54) SPRING ROLLER-TYPE PECTORALS EXERCISER

(76) Inventor: David Miraflor, P.O. Box 313467, Jamaica, NY (US) 11431

( * ) Notice: Subject to any disclaimer, the term of this patent is extended or adjusted under 35 U.S.C. 154(b) by 101 days.

(21) Appl. No.: 09/800,377

(22) Filed: Mar. 7, 2001

(65) Prior Publication Data

US 2002/0128130 A1 Sep. 12, 2002

(51) Int. Cl.[7] ..... A63B 26/00; A63B 71/00
(52) U.S. Cl. ..... 482/141; 482/106; 446/78
(58) Field of Search ..... 482/141, 104, 482/106, 108; 446/78, 88, 93, 95

(56) References Cited

U.S. PATENT DOCUMENTS 2,821,394 A * 1/1958 Barbeau
3,712,359 A * 1/1973 Williams ..... 152/158
5,114,387 A * 5/1992 Keppler ..... 482/51
6,017,296 A * 1/2000 Tang et al. ..... 482/132

* cited by examiner

*Primary Examiner*—Michael A. Brown
*Assistant Examiner*—Lori Baker Amerson

(57) ABSTRACT

A pectorals-focused exercising routine in which springs of left and right hand exercisers are urged in opening movements to windup the springs so that under spring urgency, the exerciser is raised to a ready position during closing movement, and traction to obviate slippage is established using interengaged friction surfaces to maximize spring tension during the opening movement and minimize loss of tension not effective in lifting the exerciser during closing movement.

1 Claim, 1 Drawing Sheet

SPRING ROLLER-TYPE PECTORALS EXERCISER

The present invention relates generally to spring roller-type exercise devices in which alternate movements wind-up and unwind a spring, the urgency of which during the unwind phase assists in lifting the upper torso of the exerciser into a ready position to repeat the wind-up phase, and more particularly relates to improvements which contribute to the use of the devices for a pectorals exercise routine.

EXAMPLES OF THE PRIOR ART

For abdominals-development exercise routines there are numerous spring wind-up and unwind exercise devices, as exemplified by U.S. Pat. No. 3,752,475 for "Axle-Mounted Wheel Exercising Device with Spring Resistance Located Centrally Within The Wheel" issued to Arnold C. Ott on Aug. 14, 1973, U.S. Pat. No. 6,017,296 for "Exercise Wheel" issued to Jack Tung on Jan. 25, 2000, and U.S. Pat. No. 6,146,318 for "Push And Pull Type Roller Exerciser" issued to Hui Kuei Kuo on Nov. 14, 2000, to mention but a few. In the operating mode of each and in all other similar devices, the exerciser is instructed to urge the device in movement longitudinally of a starting kneeling position so that the weight of the upper torso is brought to bear on the device to provide the necessary traction to cause the rotating wheel or roller to wind-up the spring and, in a return direction to cause proper release of the spring urgency to assist in raising the upper torso into a ready position to repeat the exercise. Slippage in either direction is undesirable and a waste of the spring urgency.

While the directional movements noted are appropriate for abdominals-development exercise routines, for pectorals-development exercise routines transverse directional movements are better suited, and in this instance arm strength is required to provide traction with only nominal assistance of a downwardly bearing weight of the upper torso of the exerciser on left and right hand-manipulated spring operated rollers. The requisite arm strength is often beyond the capacity of most individuals and thus the exercise routines are often limited to abdominals or to modified, and less desirable pectorals, such as in angularly oriented and not perpendicular transverse directions.

Broadly, it is an object of the present invention to adapt spring roller-type exercise rollers for pectorals exercise routines, thereby overcoming the foregoing and often shortcomings of the prior art.

More particularly, it is an object to supplement arm strength, even though nominal, with traction-establishing conjointly used components to effectively perform pectorals exercise routines, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 6:
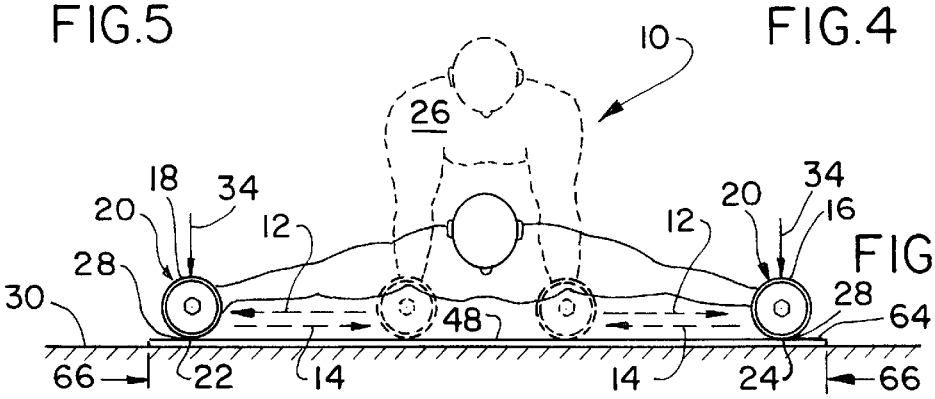
FIG. 6 is a diagramatic view illustrating a pectorals exercise routine.

As best understood from FIG. 6, a pectorals exercise routine contemplates alternate arm thrusts of an exerciser 10 in opening and closing movements 12 and 14 using identically constructed left hand 16 and right hand 18 spring-embodied rollers, generally designated 20, in the extreme spread apart locations 22 and 24 of which as depicted in FIG. 6, the upper torso 26 of the exerciser 10 is between the locations 22, 24 and thus does not bring to bear any weight of the upper torso to any traction of the rollers 20 at the sites 28 where such traction must be established between the rollers 20 and a support surface 30. As it will be better understood as the description proceeds, in the absence of traction at the sites 28 and at locations immediately prior thereto, there will be slippage and thus loss of spring urgency of the embodied springs 32 of the devices 16, 18 which is the power source for raising the upper torso from its full line exercise position to its ready position, illustrated in phantom perspective, preparatory to repeating the arm thrusts in the movement directions 12 and 14.

Figure 2:
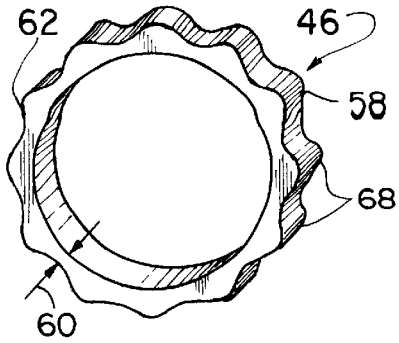
FIG. 2 is an isolated perspective view of a traction-establishing component for said FIG. 1 devices.

Underlying the present invention is the recognition that in the extreme spread apart exercise position depicted in FIG. 6, the exerciser 10 must exert a downward vertical force using his/her arm strength and that this necessary force 34 is usually beyond the strength of average individuals and thus inadequate for the purposes intended, namely to maintain sufficient traction at the sites 28. However, it has been found in practice that the force 34, although nominal, is adequate to maintain traction at the sites 28 if use is made of traction-establishing components, as exemplified by the components of FIGS. 2 and 3, now to be described in detail.

Figure 1:
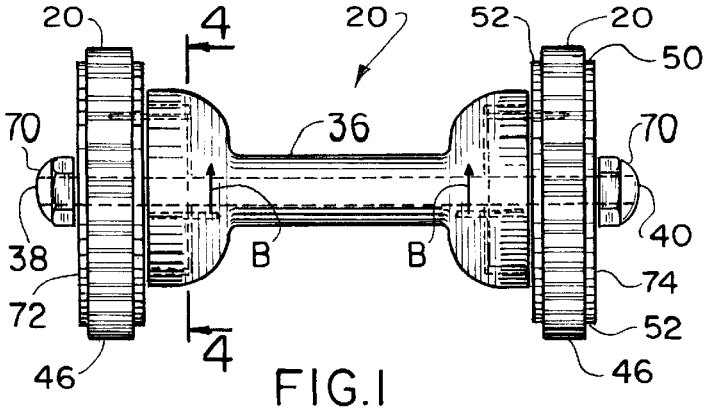
FIG. 1 is a plan view of one of a cooperating pair of left hand and right hand-manipulated spring-roller type exercise devices having particular utility for a pectorals exercise routine.
Figure 5:
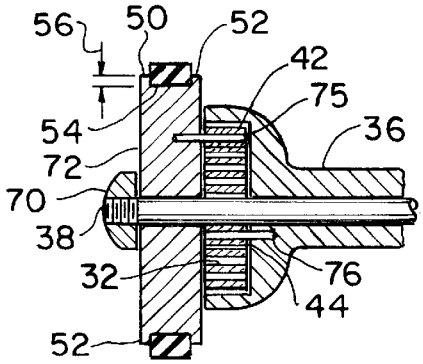
FIG. 5 is a diametrical cross section of one end of the device of FIG. 1 illustrating the internal arrangement of the spring component thereof.
Figure 4:
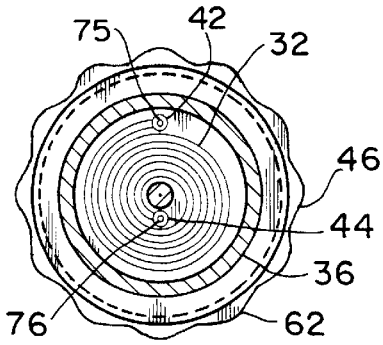
FIG. 4 is a sectional view of the device of FIG. 1 as taken along line 4—4 of FIG. 1.

Preliminarily however, and with particular reference to FIGS. 1, 4 and 5, an understanding of the construction and operating mode of the device 16, and those also of device 18, of the noted drawing figures is helpful and now follows. Each device 16 has a cylindrical grip handle 36 having opposite ends 38 and 40, and appropriately journalled for rotation on the ends 38, 40 are the previously noted rollers, individually and collectively designated, again as already noted by the reference numeral 20. A helical spring 32 having opposite ends 42 and 44 is embodied in each roller 20, one end 42 being appropriately attached by welding or the like to the roller 20 and the other end 44, again by welding or the like, to the handle 36, so that the urging of the roller 20 through opening directions of movement 12 winds the helical spring 32 in helical turns to increase the tension of the spring, and the urging of the roller 20 through closing direction of movement 14 unwinds the helical spring 32 and causes the release of the spring urgency to contribute to raising the upper torso 26 of the exerciser 10 to the exercise routine ready position.

To maintain traction at the sites 28, which minimizes loss of spring urgency during opening movements 12 and maximizes the extent of spring urgency released during closing movements 14, use is made of the traction-establishing components 46 and 48. More particularly, in a preferred embodiment, each roller 20 in a peripheral edge 50 is appropriately provided, by machining or otherwise, with spaced apart walls 52 and bounding therebetween a circumferential recess 54 of a selected depth 56, of approximately ¼ of an inch. Seated in the recess is a closed loop elastomeric or rubber flat band 58 of a thickness 60 slightly in excess of the depth 56 of the recess 54 so that in its seated operative position, the outer band surface 62 protrudes beyond the roller edge 50 incident to establishing frictional engagement with the traction-establishing component 48 of FIG. 3. To seat the band 58, it is stretched into a larger loop and once positioned in the recess 54 it is released so that the band 58 assumes a slightly stretched condition and consequently, the band 58 is maintained in the recess 54 under the urgency of its elastomeric construction material.

Figure 3:
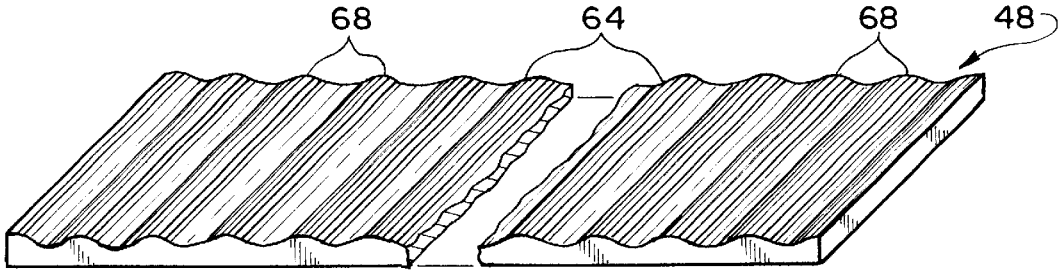
FIG. 3 is likewise an isolated perspective view but of another traction-establishing component used in conjoined relation with the devices of FIG. 1.

Referring now to FIG. 3, the traction-establishing component 48 is a planar article of manufacture of elastomeric construction material in the specific form of a rectangular strip having a friction surface 64 in facing relation to the exerciser 10 when the strip component 48 is in its in-use position of FIG. 6 disposed transversely of the exerciser 10 in a vertical plane coincident with, and beneath the shoulder area of the exerciser's upper torso, a position extending for the full length and slightly beyond, as noted at 66, the full anticipated spread apart positions of movement of the rollers 20.

Supplementing the inherent friction against movement relative to the interengaging surfaces 62 and 64 respectively of the band 46 and strip 48 as provided by their elastomeric construction material, in a preferred embodiment the surfaces 62, 64 are appropriately formed, by extrusion molding or otherwise, with an array of surface undulations or alternate spaced apart crests and recesses, individually and collectively designated 68, which contributes to maintaining the surfaces 62, 64 in rolling contact with each other and, most important, without slippage.

In embodiments in which the spring ends 42, 44 are mechanically attachable and detachable, the exerciser 10 has the option of changing the spring to one providing an increased tension perhaps more in line with increased developed arm strength. This can be easily accomplished by removing the retaining nuts 70 and the wheel portions 72, 74 so as to disengage the pins 75 from the ends of the springs 32. Then the other ends of the springs can be disengaged from the first pins 76 and the springs removed. The wheel portions 72, 74 can then be replaced and are free for rotational movement in either direction. Further, an indicating marker or signal, for example an arrow, as indicated at "B" is provided on one or both of the grip portion ends to show which way the device should be grasped to achieve the winding up action of the springs 32.

While the apparatus for practicing the within inventive pectorals exercise routine herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A cooperating pair of identically constructed left hand and right hand spring roller exerciser devices for a pectorals exercise routine in the operating mode of which said devices are alternately urged along a transverse path of movement in opening and closing relation to each other, each said spring roller exerciser device comprising a cylindrical grip handle having opposite ends, at least two rollers journalled for rotation in spaced apart relation on said opposite ends of said grip handle, a helical spring having opposite ends, one said spring end connected to said handle and said other spring end to one said roller effective to cause a winding of said spring in tension in response to rotation of said roller, a planar strip of elastomeric construction material operatively disposed in a transverse relation to said exerciser, a bottom of said planar strip presenting a first friction surface in contact with a support surface beneath said exerciser and a top thereof presenting a second friction surface in facing relation to said exerciser, said friction surface on said top of said planar strip characterized by alternate spaced apart crests and recesses, and a peripheral friction surface on each said roller characterized by alternate spaced apart crests and recesses in frictional engagement with said second friction surface of said planar strip, whereby during said exercise routine opening movements there is nominal loss of traction between said rollers and planar strip to correspondingly maximize spring urgency during said closing movements thereof.

* * * * *